US009682811B2

(12) United States Patent
Roth

(10) Patent No.: US 9,682,811 B2
(45) Date of Patent: Jun. 20, 2017

(54) PACKAGE FOR EGGS AND METHOD FOR MANUFACTURING SAID PACKAGE

(75) Inventor: Hans Erik Roth, Aabenraa (DK)

(73) Assignee: BRØDRENE HARTMANN A/S, Gentofte (DK)

( * ) Notice: Subject to any disclaimer, the term of this patent is extended or adjusted under 35 U.S.C. 154(b) by 0 days.

(21) Appl. No.: 14/344,649

(22) PCT Filed: Aug. 21, 2012

(86) PCT No.: PCT/IB2012/054229

§ 371 (c)(1),
(2), (4) Date: Jun. 1, 2015

(87) PCT Pub. No.: WO2014/030032

PCT Pub. Date: Feb. 27, 2014

(65) Prior Publication Data

US 2015/0266659 A1 Sep. 24, 2015

(51) Int. Cl.

| | |
|---|---|
| ***B65D 85/32*** | (2006.01) |
| ***D21J 7/00*** | (2006.01) |
| ***B65D 21/02*** | (2006.01) |
| ***B65D 25/20*** | (2006.01) |
| ***B65D 81/05*** | (2006.01) |
| ***B65D 81/133*** | (2006.01) |

(52) U.S. Cl.

CPC ..... *B65D 85/324* (2013.01); *B65D 21/0233* (2013.01); *B65D 25/205* (2013.01); *B65D 81/051* (2013.01); *B65D 81/133* (2013.01); *D21J 7/00* (2013.01)

(58) Field of Classification Search

CPC ..... B65D 21/0233; B65D 21/0234; B65D 81/133; B65D 85/32; B65D 85/322

See application file for complete search history.

(56) References Cited

U.S. PATENT DOCUMENTS

| | | | | |
|---|---|---|---|---|
| 2,704,493 A * | 3/1955 | Randall | D21J 5/00 | 162/224 |
| 3,185,370 A * | 5/1965 | Reifers | B65D 85/324 | 162/231 |
| 3,305,438 A | 2/1967 | Crabtree | | |
| 3,465,947 A | 9/1969 | Andrews et al. | | |
| 7,665,608 B2 | 2/2010 | Buckley | | |

(Continued)

FOREIGN PATENT DOCUMENTS

| | | |
|---|---|---|
| DE | 14 36 939 | 4/1969 |
| EP | 1 923 332 | 5/2008 |

OTHER PUBLICATIONS

International Search Report for PCT/IB2012/054229 dated Apr. 16, 2013.

(Continued)

*Primary Examiner* — Stella Yi

(74) *Attorney, Agent, or Firm* — Marvin Petry; Stites & Harbison PLLC

(57) ABSTRACT

The present invention pertains to a method of manufacturing an egg package wherein the cooperating locking means in a cover part and bottom part of the egg package are formed and placed relative to each other so that form changes in the cover part arising during manufacture are compensated for The invention furthermore pertains to an egg package manufactured according to the above mentioned method.

20 Claims, 6 Drawing Sheets

(56) References Cited

U.S. PATENT DOCUMENTS

| | | | | |
|---|---|---|---|---|
| 2003/0136537 | A1 | 7/2003 | Frederiksen et al. | |
| 2005/0238764 | A1 | 10/2005 | Beese | |
| 2005/0274642 | A1* | 12/2005 | Buckley ..... | B65D 85/32<br>206/521.1 |

OTHER PUBLICATIONS

Written Opinion of the International Searching Authority for PCT/IB2012/054229 dated Apr. 16, 2013.
International Search Report for PCT/IB2012/054722 dated Apr. 11, 2013.
Written Opinion of the International Searching Authority for PCT/IB2012/054722 dated Apr. 11, 2013.

* cited by examiner

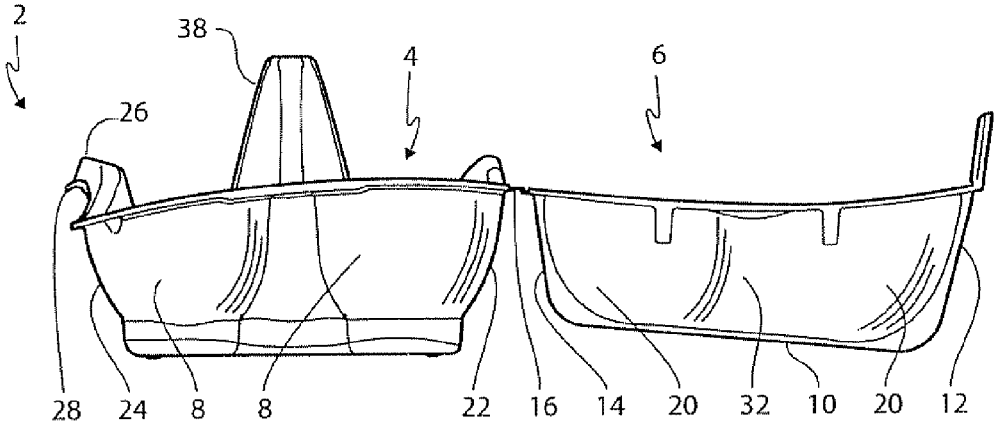
FIG. 5
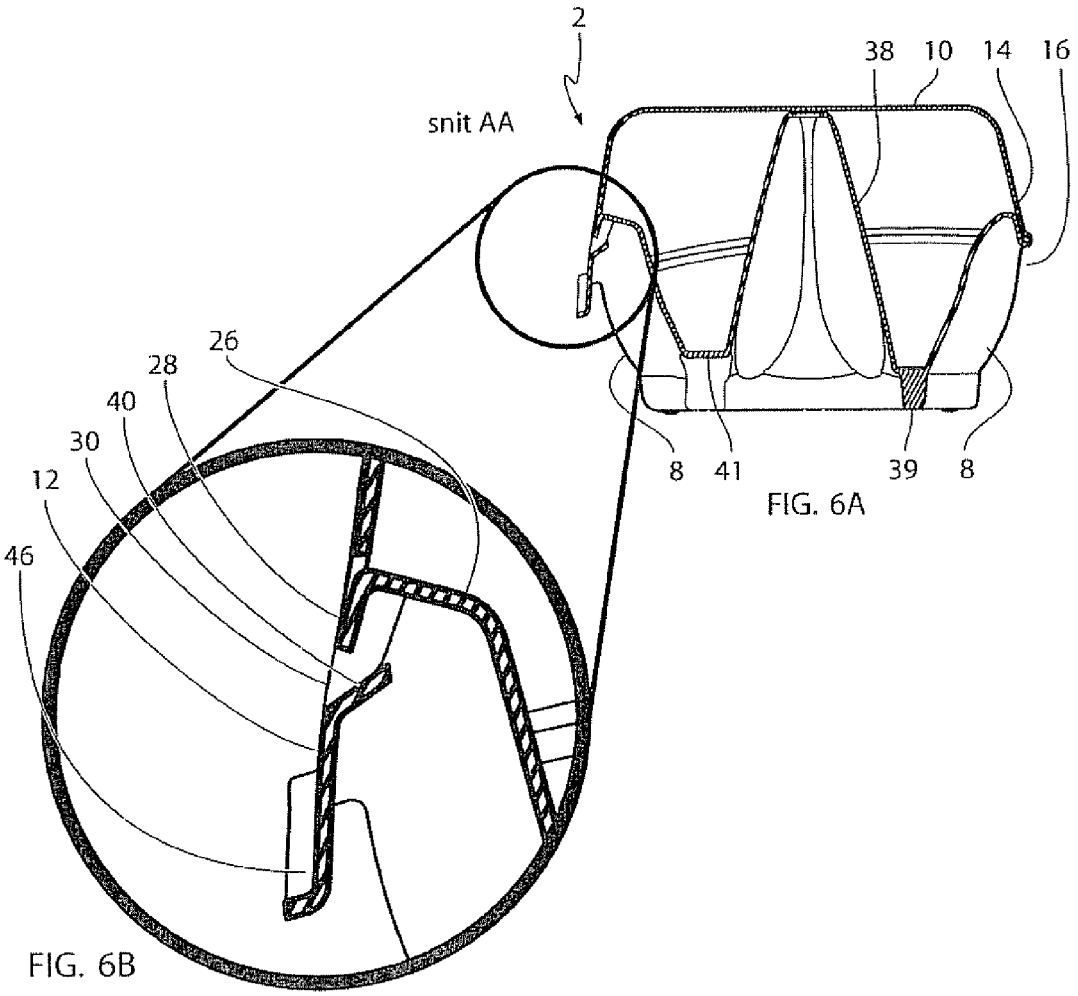
FIG. 6A
FIG. 6B

PACKAGE FOR EGGS AND METHOD FOR MANUFACTURING SAID PACKAGE

TECHNICAL FIELD

The present invention pertains to a method of manufacturing a package for eggs and an egg package itself.

BACKGROUND OF THE INVENTION

Packages for packing and transporting eggs are known in a variety of forms. Traditionally, such packages have comprised a bottom part provided with suitably shaped compartments for accommodation of the eggs, and an upper part forming a cover over the bottom part for accommodating the upper portions of the eggs housed within the package and for closing the package. Often, the upper part is connected to the lower part by means of a suitable hinge portion, although packages comprising separate bottom and upper parts have also been used. In those packages that comprise a hingedly connected bottom and cover part, the vertical front side of the bottom part is often provided with a flexible flap hinged to and protruding from the bottom part, the flap comprising a number of protrusions for engagement with correspondingly located and shaped holes in the cover part, thereby locking the bottom and cover parts together in the closed state of the package.

EP 1 373 100 discloses a display and distribution packaging unit for fragile articles, especially for eggs, comprising a bottom part which at least partially matches the outer contours of the eggs housed within the unit, and a cover part comprising planar top- and side surfaces for the provision of graphical information about the contents of the unit, where portions of the end surfaces of the cover part are shaped to reflect the shape of the eggs housed within the display and distribution package. A problem with this egg package is that the closing and locking mechanism is provided by a traditional locking flap having a protrusion, which extends through an aperture in the front side of the cover part, thus reducing the available place for a label.

Thus, in the prior art egg packages it has only been possible to place a label on the top surface of the cover part, which often is not visible when the egg packages are stacked in a sales rack. Thus, there has always been a conflict between having a large surface for the placement of a label and at the same time having a reliable closing and locking mechanism, i.e. a large area for a label without compromising the reliability of the locking mechanism. Additionally, a closure flap as known from EP 1 373 100 is an element that increases the cost of manufacture and transport of the egg packages.

SUMMARY OF THE INVENTION

It is therefore an object of the present invention to provide an egg package—without the provision of a traditional locking flap—which may be reliably closed and locked in a substantially error free manner by a machine.

According to the present invention, the above-mentioned and other objects are fulfilled by a method of producing an egg package by suction moulding of a fibrous material, the egg package comprising the following main parts:

a bottom part comprising a plurality of egg receiving compartments having non-planar side surfaces so as to match at least partially the outer contours of an egg, the plurality of compartments being formed in at least two parallel rows, a cover part comprising a top surface, a front surface, a back surface, and two end surfaces, the cover part being permanently connected to the bottom part by a hinge between the back surface of the cover part and the bottom part so as to allow the cover part to move between an open position and a closed position, the bottom part comprising a back side, a front side, two end sides, and a upwardly extending retainment projection extending from the front side of the bottom part, the upwardly extending retainment projection having a downwardly and outwardly extending nose for locking engagement with a co-operating aperture in the front surface of the cover part, the nose not extending beyond the front surface of the cover part when the cover part is in its closed position, wherein the method comprising the steps of.

placing said retainment projection and co-operating aperture relative to each other during moulding of the egg package in a moulding form, such that deformations in the cover part during manufacture are compensated for, removing the egg package from the form, and drying said egg package in an oven.

An egg package formed by suction moulding of a fibrous material would possess some degree of stiffness in the bottom part, because the bottom part comprises the egg receiving compartments, whereas the cover part comprises larger substantially flat surfaces. These larger surfaces are less stiff and therefore also more prone to deformation during the manufacturing process, i.e. after they are removed from the mould and dried in the oven. These deformations are usually not large enough to cause problems in relation to the reliability of the traditional egg packages, which are equipped with a large locking flap. However, since the nose in the egg package manufactured according to the inventive method does not extend beyond the front surface of the cover part when the cover part is in its closed position, even very small deformations in the cover part may lead to an unreliable locking of the egg package. Since egg packages are machine handled at a tremendous speed in an egg packaging facility, the facilitation of a reliable and error free locking of them is of critical importance. Thus, by placing the retainment projection and co-operating aperture relative to each other during moulding of the egg package in a moulding form, such that the above mentioned deformations in the cover part during manufacture are compensated for, it is achieved that the egg package can be locked and closed in a substantially error free manner by the existing packaging machinery being used in handling prior art packages.

Hence, a reliable and stable locking function which may be facilitated by simple mechanical closing means is achieved, for example provided by packing machinery, without the risk of damaging the fragile eggs being placed in the package. This is due to the fact that the egg package according to the above embodiment may be closed and locked in one operation by pivoting the cover part in relation to the hinge. This pivoting of the cover part may thus be facilitated by the packaging machinery by only one mechanical operation. Typically, packaging machinery is adapted for handling a tremendous number of packages over a short time span. It is therefore an important advantage of the present embodiment that the package can be closed and locked in an error free and reliable manner by the packaging machinery. Since, the noses are projecting downwardly and outwardly, the cooperating apertures on the cover part can slide over the noses during closing of the egg package and engage them in a locking manner, because the noses will simply work as hooks that hook onto a lower edge of the aperture. This way a simple—yet effective way—of providing reliable locking means on the cover part is achieved and an easy manufacture of the egg package. The number of such apertures corresponds to the number of noses.

In an embodiment, the method according to the invention further comprises the step of attaching a label to the top surface and front surface of the cover part with an adhesive. This label covers the apertures in the front side of the cover part, thereby giving it a more clean and appealing look. Since, the noses do not extend beyond the front surface of the cover part when the cover part is in its closed position, it is possible to equip the cover part with a label covering the top surface and the entire front surface of the cover part.

In a further embodiment, the method comprises a step of after-pressing said egg package in order to provide an egg package with a more smooth surface.

In a further embodiment, the method further comprises the step of forming a pillow post between each two neighboring egg receiving compartments, wherein at least one pillow post being formed between the egg receiving compartments adjacent to the front side of the bottom part is higher than 7 mm as measured from the bottom of the neighboring egg receiving compartments. Hereby is achieved that the upwardly extending retainment projection extending from the front side of the bottom part has an increased rigidity. This increased stability of the upwardly extending retainment projection (extending from the front side of the bottom part at the same place as the at least 7 mm high pillow post) increases further the reliability of the locking function of the egg package, which—as mentioned before—is machine handled at a tremendous speed in an egg packaging facility, where it is of critical importance that it may be closed and locked by an automatic packaging machine in an error free manner in order to reduce the need for human intervention during the packaging of eggs.

In a further embodiment of the method according to the invention, the at least one pillow post being formed between the egg receiving compartments adjacent to the front side of the bottom part has a height between 7 mm and 20 mm, preferably a height between 7 mm and 15 mm, as measured from the bottom of the neighboring egg receiving compartments. Hereby is achieved a sufficient tradeoff between the desired form stability and stiffness of the upwardly extending retainment projection and the height of the adjacent pillow post.

In a further embodiment of the method according to the invention, the at least one pillow post being formed between the egg receiving compartments adjacent to the front side of the bottom part is higher than all the other pillow posts in said egg package. Hereby is achieved that the required form stability and stiffness of the upwardly extending retainment projection is achieved without having to increase the height of the other pillow posts and therefore without having to use extra fibrous material, e.g. pulp, in the production of said egg package.

In a further embodiment of the method according to the invention, said egg package may comprise at least eight egg receiving compartments formed in two parallel rows, and at least three upwardly extending retainment projections, wherein the step of compensating for deformations of the cover part during manufacture comprises the substep of forming said retainment projections along a convex curve, so that the noses of the upwardly extending retainment projections closest to the end sides of the bottom part are placed closest to the front side of the bottom part.

The inevitable deformations of the cover part during manufacture, which affects the reliability and stability of the locking function, are mainly caused by an outwardly bulging of the front side of the cover part. Accordingly, the size of this deformation is depending on the overall size of said front side of the cover part. This bulging of the front side of the cover part is at least in part compensated for by forming the retainment projections along a convex curve, so that the noses of the upwardly extending retainment projections closest to the end sides of the bottom part are placed closest to the front side of the bottom part. The relative offset of the noses may be between 0.3 mm and 2 mm, preferably between 0.3 mm and 1 mm. Investigations by the applicant have shown that good results may be achieved within these ranges by for example using an offset of 0.5 mm. It is a great advantage that these offsets may be performed by incorporating only minor changes in the already existing form tools used for other egg packages.

In a further embodiment of the method according to the invention, the co-operating apertures in the front surface of the cover part are offset upwardly and/or downwardly relative to each other when the egg package is formed. Hereby is achieved a more reliable locking function of the egg package. The relative offset of the co-operating apertures in the front surface of the cover part may be between 0.3 mm and 2 mm, preferably between 0.5 mm and 1.3 mm, for example 1 mm.

A preferred embodiment of the method according to the invention further comprises the step of forming a tongue in the cover part extending upwardly and inwardly from the lower edge of the one or more apertures, said lower edge of the one or more apertures being substantially flush with the front surface of the cover part, said tongue being configured for cooperating with the at least one outwardly and downwardly extending nose. Hereby is achieved a simple—yet effective—locking mechanism, wherein the egg package can be closed and locked by a single mechanical operation of a packaging machinery, because when the package is being closed, the inwardly and upwardly extending tongue will slide over the outwardly and downwardly extending nose. During this sliding, the nose and tongue will bend slightly, and then relax back to the normal position when they slide pass each other—due to the slight resilience of the fibrous material.

In a preferred embodiment of the method according to the invention, the interface between the cover part and bottom part inclines downwardly from the rear side of the package to the front side, thus yielding a higher front surface of the cover part than back surface of the cover part, thereby yielding a higher front side of the cover part than rear side of the cover part, the higher front side thereby providing more space for the attachment of labels, etc. On opening the cover part of the filled packaging unit, a larger part of the eggs contained in the unit thus becomes visible from the front side of the unit, which is normally the side of the unit facing the customer in a store. This provides for a better opportunity to inspect the eggs in the unit, for instance for possible damages hereof, and has the further effect that the eggs in the unit appear larger. The interface between the cover part and bottom part is preferably curved.

In a preferred embodiment of the method according to the invention, the lower edge of the front surface of the cover part is curved in a downward direction beneath an interface between the cover part and bottom part for extension of the area of the front surface and for facilitating the opening of the unit. This is done in order to provide a better grip of the edge portion of the cover part for opening the unit—and also in order to further increase the area of the front surface of the cover part and hence the possibility to attach labels etc to this portion of the cover part. For example, the lower edge of the front surface may according to the invention be extended in a downwards direction past the interface between the cover part and the bottom part. The downward extension of the front surface of the cover part may cover up to the total height of the bottom part.

The above mentioned and further objects are furthermore achieved by a second aspect of the invention, pertaining to an egg package formed by suction moulding of a fibrous material, the package comprising the following main parts:

- a bottom part comprising a plurality of egg receiving compartments having non-planar side surfaces so as to match at least partially the outer contours of an egg, the plurality of compartments being formed in at least two parallel rows,
- a cover part comprising a top surface, a front surface, a back surface, and two end surfaces,
- the cover part being permanently connected to the bottom part by a hinge between the back surface of the cover part and the bottom part so as to allow the cover part to move between an open position and a closed position,
- the bottom part comprising a back side, a front side, two end sides, and a upwardly extending retainment projection extending from the front side of the bottom part,
- the upwardly extending retainment projection having a downwardly and outwardly extending nose for locking engagement with a co-operating aperture in the front surface of the cover part,
- the nose not extending beyond the front surface of the cover part when the cover part is in its closed position, wherein said retainment projection and co-operating aperture are placed relative to each other, such that deformations in the cover part during manufacture are compensated for.

A preferred embodiment of the package according to the second aspect may further comprise a label which is attached to the top surface and front surface of the cover part with an adhesive.

A further embodiment of the package according to the second aspect may further comprise a pillow post formed between each two neighboring egg receiving compartments, wherein at least one pillow post being formed between the egg receiving compartments adjacent to the front side of the bottom part is higher than 7 mm as measured from the bottom of the neighboring egg receiving compartments.

In a further embodiment of the package according to the second aspect, the at least one pillow post being formed between the egg receiving compartments adjacent to the front side of the bottom part has a height between 7 mm and 20 mm, preferably a height between 7 mm and 15 mm, as measured from the bottom of the neighboring egg receiving compartments.

In a further embodiment of the package according to the second aspect the at least one pillow post being formed between the egg receiving compartments adjacent to the front side of the bottom part is higher than all the other pillow posts in said egg package.

In a further embodiment of the package according to the second aspect, the egg package comprises at least eight egg receiving compartments formed in two parallel rows, and at least three upwardly extending retainment projections, wherein the step of compensating for deformations of the cover part during manufacture comprises the substep of forming said retainment projections along a convex curve, so that the noses of the upwardly extending retainment projections closest to the end sides of the bottom part are placed closest to the front side of the bottom part.

In a further embodiment of the package according to the second aspect, the relative offset of the noses is between 0.3 mm and 2 mm, preferably between 0.3 mm and 1 mm.

In a further embodiment of the package according to the second aspect, the co-operating apertures in the front surface of the cover part are offset upwardly and/or downwardly relative to each other when the egg package is formed.

In a further embodiment of the package according to the second aspect, said relative offset of the co-operating apertures in the front surface of the cover part is between 0.3 mm and 2 mm, preferably between 0.5 mm and 1.3 mm.

A further embodiment of the package according to the second aspect further comprises a tongue formed in the cover part and extending upwardly and inwardly from the lower edge of the one or more apertures, said lower edge of the one or more apertures being substantially flush with the front surface of the cover part, and said tongue being configured for cooperating with the at least one outwardly and downwardly extending nose.

A preferred embodiment of the second aspect of the invention further comprises an interface between the cover part and bottom part that inclines downwardly from the rear side of the package to the front side when the egg package is closed, thus yielding a higher front surface of the cover part than back surface of the cover part. Said interface is preferably curved.

The above mentioned and further objects of the invention are achieved by a third aspect of the invention pertaining to a package for eggs, said package being formed of a fibrous material and comprising the following main parts.

- a bottom part comprising a plurality of egg receiving compartments having non-planar side surfaces so as to match at least partially the outer contours of an egg, the plurality of compartments being formed in at least two parallel rows,
- a cover part comprising a top surface, a front surface, a back surface, and two end surfaces,
- the cover part being permanently connected to the bottom part by a hinge between the back surface of the cover part and the bottom part so as to allow the cover part to move between an open position and a closed position,
- the bottom part comprising a back side, a front side, two end sides, and at least one upwardly extending retainment projection extending from the front side of the bottom part,
- the upwardly extending retainment projection having a downwardly and outwardly extending nose for locking engagement with one or more co-operating apertures in the front surface of the cover part,
- the nose not extending beyond the front surface of the cover part when the cover part is in its closed position, and
- a pillow post formed between each two neighboring egg receiving compartments, wherein at least one pillow post being formed between the egg receiving compartments adjacent to the front side of the bottom part is higher than 7 mm as measured from the bottom of the neighboring egg receiving compartments Hereby is achieved an increased stability and stiffness of the upwardly extending retainment projection (extending from the front side of the bottom part at the same place as the at least 7 mm high pillow post), which thereby further increases the reliability of the locking function of the egg package, which—as mentioned before—is machine handled at a tremendous speed in an egg packaging facility, where it is of critical importance that it may be closed and locked by an automatic packaging machine in an error free manner in order to reduce the need for human intervention during the packaging of eggs.

In an embodiment of the third aspect of the invention, the at least one pillow post being formed between the egg receiving compartments adjacent to the front side of the bottom part has a height between 7 mm and 20 mm, preferably a height between 7 mm and 15 mm, as measured from the bottom of the neighboring egg receiving compartments.

In a further embodiment of the third aspect of the invention, the at least one pillow post being formed between the egg receiving compartments adjacent to the front side of the bottom part is higher than all the other pillow posts in said egg package.

In a further embodiment of the third aspect of the invention, the egg package comprises at least eight egg receiving compartments formed in two parallel rows, and at least three upwardly extending retainment projections, said retainment projections being formed along a convex curve, so they thereby are offset relative to each other such that the noses of the upwardly extending retainment projections closest to the end sides of the bottom part are placed closest to the front side of the bottom part.

In a further embodiment of the third aspect of the invention, the relative offset of the noses is between 0.3 mm and 2 mm, preferably between 0.3 mm and 1 mm.

In a further embodiment of the third aspect of the invention, the co-operating apertures in the front surface of the cover part are offset upwardly and/or downwardly relative to each other.

In a further embodiment of the third aspect of the invention, the relative offset of the—operating apertures in the front surface of the cover part is between 0.3 mm and 2 mm, preferably between 0.5 mm and 1.3 mm.

In a further embodiment of the third aspect of the invention, the cover part is provided with a label covering the top surface and a substantial part of the front surface of the cover part.

In a further embodiment of the third aspect of the invention, the cover part comprises a tongue, which extends upwardly and inwardly from the lower edge of the one or more apertures, said lower edge of the one or more apertures being substantially flush with the front surface of the cover part, and said tongue being adapted for cooperating with the outwardly and downwardly extending nose. Hereby is achieved a simple—yet effective locking mechanism, wherein the egg package can be closed and locked by a single mechanical operation of a packaging machinery, because when the package is closed, the inwardly and upwardly extending tongue will slide over the outwardly and downwardly extending nose. During this sliding, the nose and tongue will bend slightly, and then relax back to the normal position when these parts slide pass each other—due to the slight resilience of the fibrous material.

In a further embodiment of the third aspect of the invention, the interface between the cover part and bottom part inclines downwardly from the rear side of the package to the front side, thus yielding a higher front surface of the cover part than back surface of the cover part, thereby yielding a higher front side of the cover part than rear side of the cover part, the higher front side thereby providing more space for the attachment of labels, etc. On opening the cover part of the filled packaging unit, a larger part of the eggs contained in the unit thus becomes visible from the front side of the unit, which is normally the side of the unit facing the customer in a store. This provides for a better opportunity to inspect the eggs in the unit, for instance for possible damages of the eggs, and further hast the effect that the eggs in the unit appear larger. The interface between the cover part and bottom part is preferably curved.

In a further embodiment of the third aspect of the invention, the lower edge of the front surface of the cover part is preferably curved in a downward direction beneath an interface between the cover part and bottom part for extension of the area of the front surface and for facilitating the opening of the unit. This is done in order to provide a better grip of the edge portion of the cover part for opening the unit—and also in order to further increase the area of the front surface of the cover part and hence the possibility to attach labels etc to this portion of the cover part. For example, the lower edge of the front surface may according to the invention be extended in a downwards direction past the interface between the cover part and the bottom part. The downward extension of the front surface of the cover part may cover up to the total height of the bottom part.

In a preferred embodiment, the cover part according to any of the above mentioned aspects may comprise a rim portion extending outwardly from the cover part. This rim portion may function as a gripping area for automated de-nesting machinery used in most egg packaging facilities.

In most countries there is a legal requirement that egg packages are provided with technical information about the eggs, such as farming conditions, origin, nutritional information, etc. Thus, according to a preferred embodiment of any of the above mentioned aspects of the invention, the inner side of the top surface of the cover part comprises a substantially flat and preferably also rectangular info area, onto which technical details about the eggs are provided. Hereby it is achieved that such technical information is not directly visible from outside a closed egg package and that such information therefore cannot interfere with the label and brand that the producer wants to convey to the consumer.

According to a preferred embodiment of the egg package according to any of the above mentioned aspects of the invention, the fibrous material is pulp.

Advantageously, the bottom part may, according to any of the above mentioned aspects of the invention, comprise a rim portion extending outwardly from the bottom part.

The cover of an egg package of the above mentioned kind, i.e. one that is made of a fibrous material, is usually too soft to support layers of additional egg packages filled with eggs on top of each other, for example in a sales rack. Without at least one upwardly extending projection located between the rows of egg receiving compartments to support the cover when the egg package is closed, the weight of the additional egg filled egg packages will rest on the eggs of the lower packages in the stack, which may then break during storage and transport. Thus, according to a preferred embodiment according to any of the above mentioned aspects of the invention, the inner side of the top surface of the cover part rests on the top of said upwardly extending projections of the bottom part when the cover part is in the closed position.

BRIEF DESCRIPTION OF THE DRAWINGS

A further understanding of the nature and advantages of the present invention may be realized by reference to the remaining portions of the specification and the drawings. In the following, preferred embodiments of the invention are explained in more detail with reference to the drawings, wherein FIG. 5 shows an end view of an embodiment of an open egg package, FIG. 6A-6B illustrate the closing mechanism of an embodiment of an egg package.

DETAILED DESCRIPTION

Figure 1:
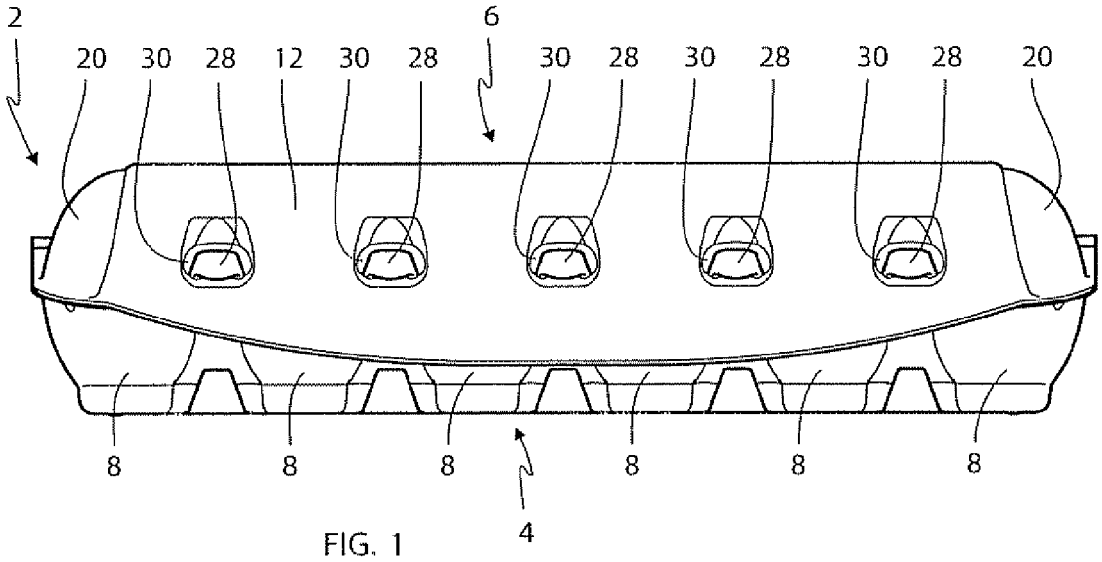
FIG. 1 shows a front view of an embodiment of an egg package according to the invention.

The present invention will now be described more fully hereinafter with reference to the accompanying drawings, in which exemplary embodiments of the invention are shown. The invention may however be embodied in different forms and should not be construed as limited to the embodiments set forth herein. Rather, these embodiments are provided so that this disclosure will be thorough and complete and fully convey the scope of the invention to those skilled in the art. Like reference numerals refer to like elements throughout. Like elements will thus not be described in detail with respect to the description of each figure.

FIG. 1-4 show an embodiment of an egg package 2 according to the invention as seen from different perspectives. The package 2 is formed of a fibrous and opaque material. The illustrated package 2 is shown in its closed position, and it comprises a bottom part 4 comprising a plurality of egg receiving compartments 8 having non-planar side surfaces so as to match at least partially the outer contours of an egg, the plurality of compartments 8 being arranged in two parallel rows.

Figure 3:
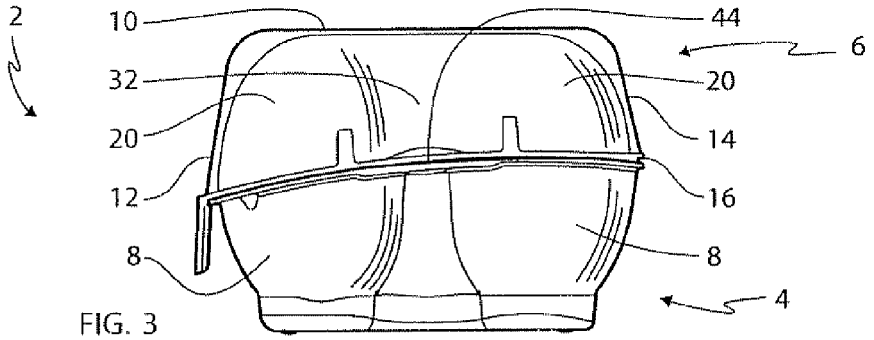
FIG. 3 shows an end view of an embodiment of an egg package according to the invention.

As can be seen more clearly in FIG. 3, the cover part 6 comprises a top surface 10, a front surface 12, and a back surface 14. The cover part 6 is permanently connected to the bottom part 4 by a hinge 16 between the back surface 14 of the cover part 6 and the bottom part 4 so as to allow the cover part 6 to move between an open position and a closed position.

Figure 2:
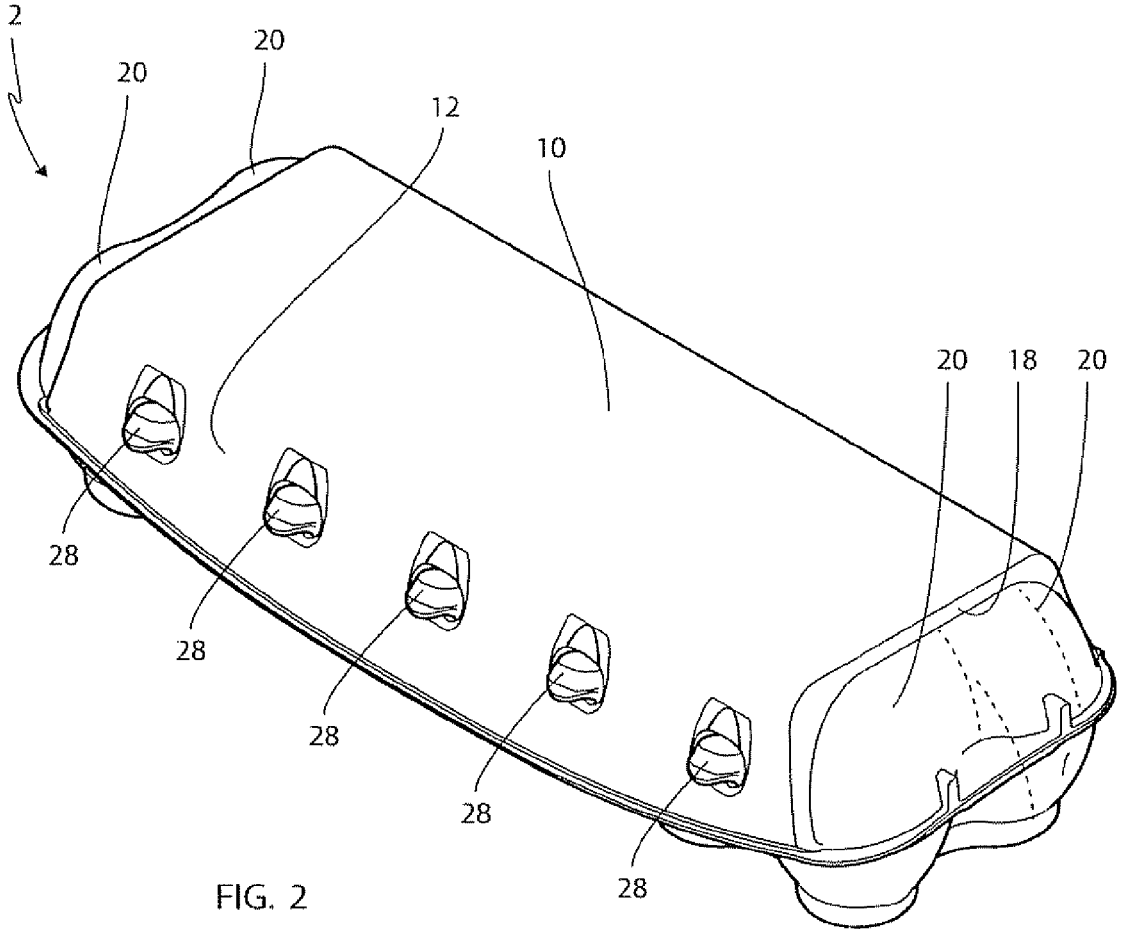
FIG. 2 shows a perspective view of an embodiment of an egg package according to the invention.
Figure 4:
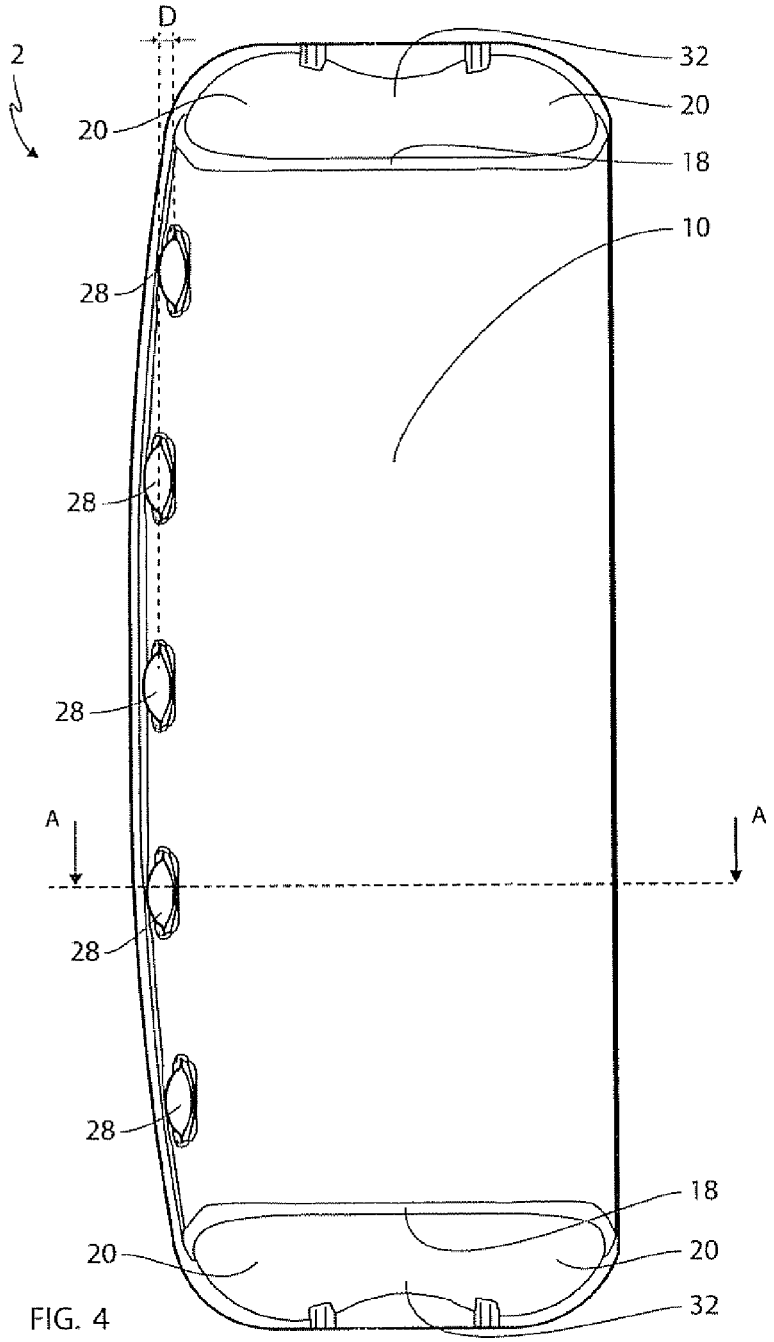
FIG. 4 shows an egg package according to the invention seen from above.

As can be seen more clearly in FIG. 2 and FIG. 4, the cover part also comprises two end surfaces. Referring now to FIG. 1-4, it is seen that the cover part 6 furthermore comprises partial ovoid portions 20 extending outwardly from the two end surfaces, wherein the partially ovoid portions 20 on the same end surface convexly and continuously extend into a continuous and concave middle section 32 connecting said two partially ovoid portions 20, said concave middle section 32, and the two partially ovoid portions 20 being circumvented by a substantially planar rim part 18, which is bounded by the top surface 10, front surface 12, and back surface 14 of the cover part 6. In essence, the concave middle section 32 and the two ovoid portions 20, together with the substantially planar rim part 18, form an end surface of the cover part 6.

In FIG. 1-4 is also shown the downwardly and outwardly extending noses 28 for locking engagement with one or more co-operating apertures 30 in the front surface 12 of the cover part 6 (see for example FIG. 1 for a better view of the apertures).

As can be e seen more clearly in FIG. 4, the downwardly and outwardly extending noses 28 (see FIG. 5 for a cross-sectional view) are placed along a convex curve such that they are offset relative to each other by a distance, D, in such a way that the noses 28 of the upwardly extending retainment projections 26 closest to the end sides of the bottom part 4 are placed closest to the front side 24 (see e.g. FIG. 5 for better view of element 24) of the bottom part 4. The inevitable deformations of the cover part 6 during manufacture, which affects the reliability and stability of the locking function, are mainly caused by an outwardly bulging of the front side 12 of the cover part 6. Accordingly, the size of this deformation is depending on the overall size of said front side 12 of the cover part 6. This bulging of the front side 12 of the cover part 6 is at least in part compensated for by forming the retainment projections 26 (see FIG. 5) along a convex curve, so that the noses 28 of the upwardly extending retainment projections 26 closest to the end sides of the bottom part 4 are placed closest to the front side 24 of the bottom part 4. The relative offset D of the noses 28 may be between 0.3 mm and 2 mm, preferably between 0.3 mm and 1 mm. Investigations performed by the applicant have shown that good results may be achieved within these ranges by for example using an offset D of 0.5 mm. It is a great advantage that these offsets may be performed by incorporating only minor changes in the already existing form tools used for other egg packages.

FIG. 5 shows the same embodiment of an egg package as shown in FIG. 1-4, but here in an end view and in the open position. In FIG. 5 it is shown that the bottom part 4 comprises a back side 22 and a front side 24 (and two end sides, which are not illustrated). Also shown in FIG. 5 is an upwardly extending retainment projection 26 extending from the front side 24 of the bottom part 4. The upwardly extending retainment projection 26 has a downwardly and outwardly extending nose 28 for locking engagement with one or more co-operating apertures 30 in the front surface 12 of the cover part 6 (see for example FIG. 1 for a better view of the apertures). The nose 28 is configured for not extending beyond the front surface 12 of the cover part 6 when the cover part 6 is in its closed position.

FIG. 6A shows a cross section of the egg package 2 illustrated in FIG. 1-5. The cover part 6 of an egg package 2 of the above-mentioned kind, i.e. one that is made of a fibrous material, is usually too soft to support layers of additional egg packages 2 filled with eggs on top of each other, for example in a sales rack. Without at least one upwardly extending projection 38 located between the rows of egg receiving compartments 8 to support the cover part 6 when the egg package is closed, the weight of the additional egg-filled egg packages will rest on the eggs of the lower packages in the stack, which may then break during storage and transport. Thus, according to a preferred embodiment, the inner side of the top surface 10 of the cover part 6 rests on the top of said upwardly extending projections 38 of the bottom part 4 when the cover part 6 is in the closed position.

Furthermore, the pillow posts 39 and 41 are shown. Pillow posts are formed between each two neighboring egg receiving compartments 8, and in the illustrated embodiment the pillow posts 41 being formed between the egg receiving compartments 8 adjacent to the front side 24 of the bottom part 4 are higher than 7 mm as measured from the bottom of the neighboring egg receiving compartments 8. Hereby is achieved an increased stability and stiffness of the upwardly extending retainment projections 26 that extend from the front side 24 of the bottom part 4 at the same place as the at least 7 mm high pillow posts 41, which thereby further increases the reliability of the locking function of the egg package 2, which—as mentioned before—is machine handled at a tremendous speed in an egg packaging facility, where it is of critical importance that it may be closed and locked by an automatic packaging machine in an error free manner in order to reduce the need for human intervention during the packaging of eggs.

In the illustrated embodiment the pillow posts 41 being formed between the egg receiving compartments 8 adjacent to the front side 24 of the bottom part 4 are higher than all the other pillow posts 39 (and pillow posts 43 illustrated in FIG. 8) in said egg package 2. Hereby is achieved that the required form stability and stiffness of the upwardly extending retainment projection 26 is achieved without having to increase the height of the other pillow posts 39 and 43, and therefore without having to use extra fibrous material, e.g. pulp, in the production of said egg package 2.

The pillow posts 41 being formed between the egg receiving compartments 8 adjacent to the front side 24 of the bottom part 4 has a height between 7 mm and 20 mm, preferably a height between 7 mm and 15 mm, as measured from the bottom of the neighboring egg receiving compartments 8.

In the close-up FIG. 6B is illustrated a cover part 6 comprising a tongue 40, which extends upwardly and inwardly from the lower edge of the one or more apertures 30, said lower edge of the one or more apertures being substantially flush with the front surface 10 of the cover part 6, and said tongue 40 being adapted for cooperating with the outwardly and downwardly extending nose 28. Hereby is achieved a simple—yet effective—locking mechanism, wherein the egg package 2 can be closed and locked by a single mechanical operation of a packaging machinery, because when the package 2 is closed, the inwardly and upwardly extending tongue 40 will slide over the outwardly and downwardly extending nose 28. During this sliding, the nose 28 and tongue 40 will bend slightly and then relax back to the normal position when they slide pass each other—due to the slight resilience of the fibrous material. The illustrated part of the front surface 12 of the cover part 6 is equipped with a label 42, covering all the locking mechanism of the egg package 2. When a user needs to open the package 2, he/she only needs to pull outwardly in the lower edge 46 of the front surface 12

Figure 7:
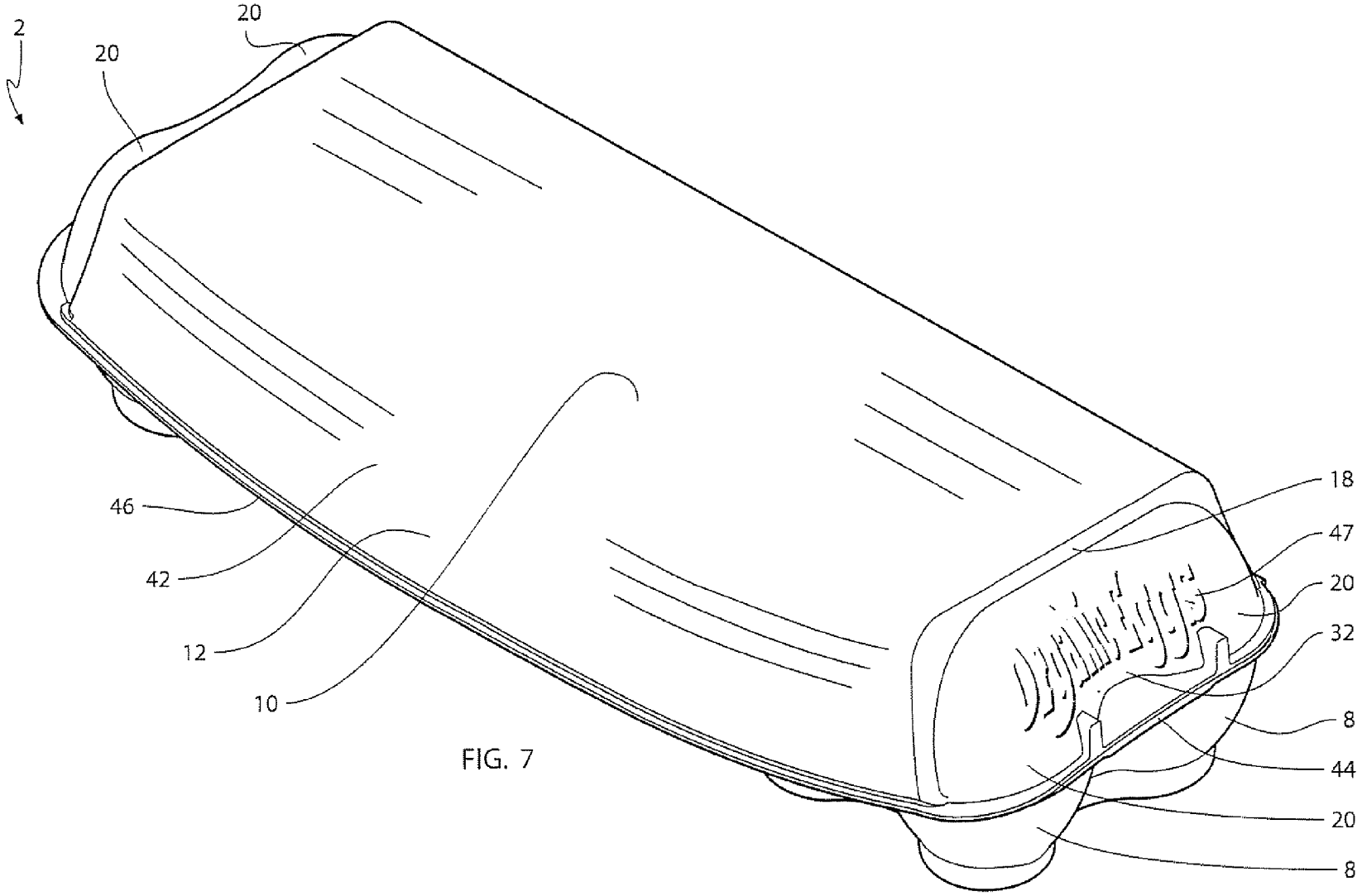
FIG. 7 shows a perspective view of an embodiment of an egg package according to the invention provided with a label.

FIG. 7 shows a perspective view of the egg package 2, wherein the cover part 6 is provided with a label 42 covering the top surface 10 and the entire front surface 12 of the cover part 6, whereby all the technical features of the locking mechanism are hidden by the label, thereby giving the unit a clean and smooth appearance. The partial ovoid portions 20 in the cover part 6 are about one quarter of a complete ovoid. This gives distinct and clear information to a consumer that this particular package 2 contains eggs.

As illustrated, the partial ovoid portions 20 of the cover part 6 continue in the corresponding egg receiving compartments 8 in the bottom part 4, the corresponding ovoid portions 20 in the cover part 6 and in the bottom part 4 thereby matching a continuous portion of a surface of an egg. Providing not only the cover part 6 with portions reflecting the shape of the eggs in the unit, but also shaping the corresponding portions 8 of the bottom part 4 such that they reflect the shape of the eggs, further enhances the visual information about the contents of the unit. The individual ovoid portions 20 of the cover part 6 and the corresponding portions 8 of the bottom part 4 may in the closed state of the unit merge into a substantially continuous surface, reflecting a relatively large portion of the surface of an egg.

The partial ovoid portions 20 together with the corresponding egg receiving compartments 8 in the bottom part 5 constitute at least approximately 60% of the total surface of an egg. Hereby, the eggs are supported in a manner which reduces the risk of damage to the eggs caused by the accelerations experienced for instance during vibrations of the package 2, or if the package 2 is accidentally dropped. Specifically, said compartments 8 can also be formed to support the eggs at the bottom portion of the compartments 8.

In some embodiments, the surface structure of the partial ovoid portions 20 and the concave middle section 32 are different than the surface structure of the remaining portions of the cover part 6. By providing those portions of the cover part 6, which reflect the contents of the package 2, with a surface structure differing from the surface structure of the remaining portions of the cover part 6, the contents of the package 2 is made even more apparent as seen from the outside, for instance by a customer in a store.

For example the surface structure of the partial ovoid portions 20 and the concave middle section 32 may be relatively smooth, while the surface structure of the remaining surfaces of the package 2 may be relatively coarse, or alternatively the surface structure of the partial ovoid portions 20 and the concave middle section 32 may be relatively coarse, while the surface structure of the remaining surfaces of the package 2 is relatively smooth.

As illustrated in FIG. 7, and more clearly in FIG. 3, the interface 44 between the cover part 6 and bottom part 4 inclines downwardly from the rear side of the package 2 to the front side, thus yielding a higher front surface 12 of the cover part 6 than back surface 14 of the cover part 6, the higher front surface 12 thereby providing more space for the attachment of labels 42, etc. On opening the cover part 6 of the filled package 2, a larger part of the eggs contained in the unit thus becomes visible from the front side of the package 2, which is normally the side of the package facing the customer in a store. This provides for a better opportunity to inspect the eggs in the unit, for instance for possible damage of the eggs, and has the further effect that the eggs in the package 2 appear larger. The interface between the cover part 6 and bottom part 4 is preferably curved.

The lower edge 46 of the front surface of the cover part is preferably curved in a downward direction beneath an interface 44 between the cover part 6 and bottom part 4 for extension of the area of the front surface 12 and for facilitating the opening of the unit. This is done in order to provide a better grip of the edge portion 46 of the cover part 6 for opening the package 2, and also in order to further increase the area of the front surface 12 of the cover part 6 and hence the possibility to attach labels 42, etc to this portion of the cover part 6. For example, the lower edge 46 of the front surface 6 may according to the invention be extended in a downward direction, past the interface 44 between the cover part 6 and the bottom part 4. The downward extension of the front surface 12 of the cover part 6 may in some (not illustrated embodiments) cover up to the total height of the bottom part 4.

In order to enhance the locking engagement between the noses 28 and the corresponding cooperating apertures 30 in the cover part, the egg package 2 may according to a preferred embodiment be so constructed that the lower part 46 of the front surface 12 of the cover part 6 bulges slightly inwardly. Such an inwardly bulging lower part 46 of the front surface 12 of the cover part 6 will, due to the slight resilience of the pulp material, slide over the upwardly extending retainment projections 26, which will force the front surface 12 to bulge outwardly in such a manner that it will slide over these projections 26 in an abutting manner until the apertures in the cover part slide over the noses 28, and therefore provide a more reliable locking engagement between the cover part 6 and the bottom part 4.

The egg package 2 is preferably formed by suction moulding of the fibrous material, which is preferably pulp.

As can be seen from the egg package 2 illustrated in FIG. 7, one of the partially ovoid portions 20 of the cover part 6 and the middle sections 32 is provided with an embossment 47. The embossment 47 extends outwardly from one of the partially ovoid portions 20 and the middle section 32. Said embossment is preferably a text and/or an ornament.

Figure 8:
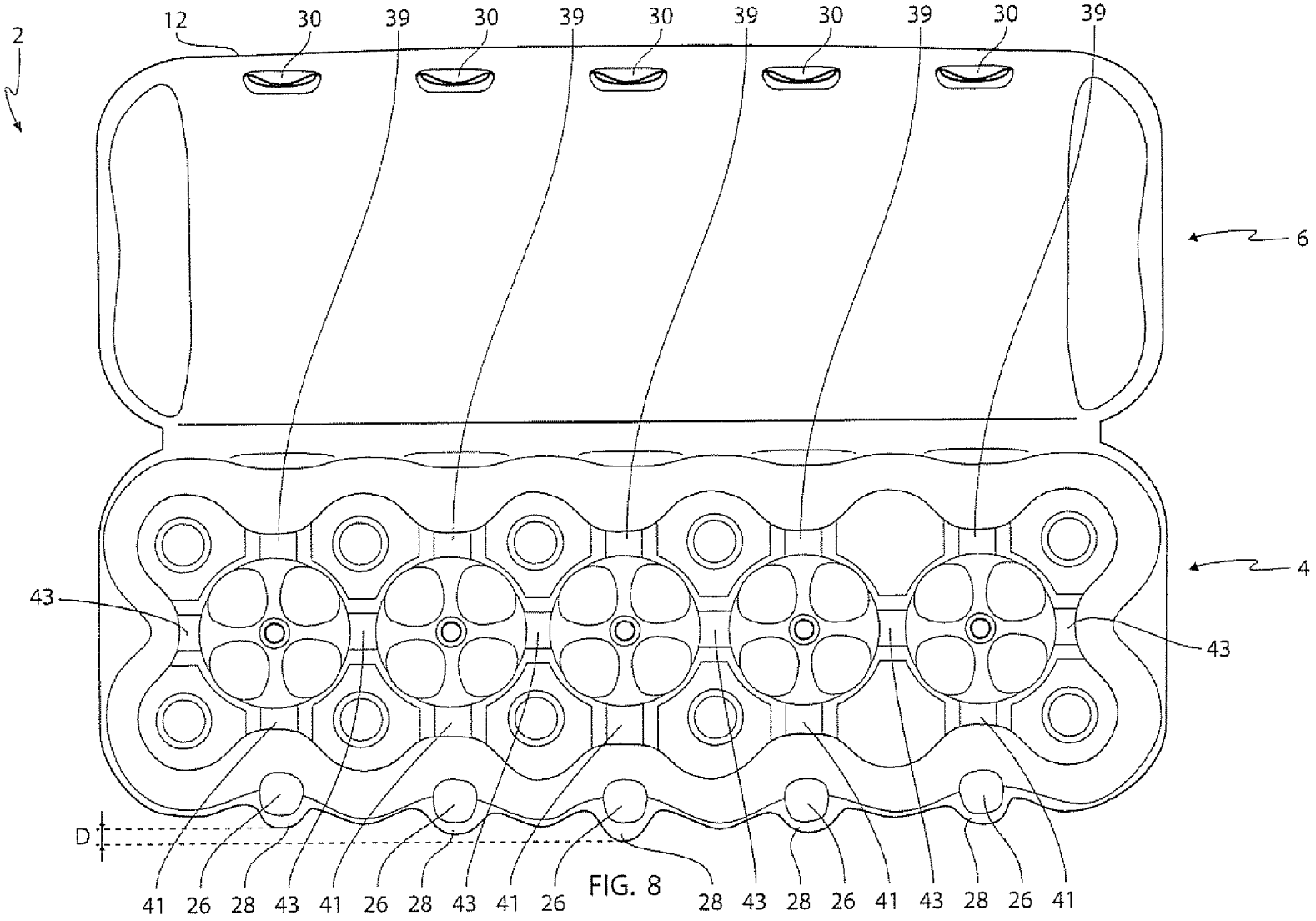
FIG. 8 shows an embodiment of an egg package according to the invention in an open position seen from above.

FIG. 8 shows a top view of an embodiment of an open egg package 2, which has just been removed from a mould. The illustrated egg package 2 comprises twelve egg receiving compartments 8 formed in two parallel rows, and five upwardly extending retainment projections 26, wherein said five retainment projections 26 have been formed along a convex curve, so that the noses 28 of the upwardly extending retainment projections 26 closest to the end sides of the bottom part 4 are placed closest to the front side 24 of the bottom part 4.

When the egg package 2 is removed from the mould, the front surface is substantially straight. However, during the subsequent steps of drying and labeling the egg package 2, the cover part 6 undergoes slight deformations, while the bottom part 4 remains more form stable due to its many non-planar parts. The inevitable deformations of the cover part 6 during manufacture affecting the reliability and stability of the locking function are mainly caused by an outwardly bulging of the front side 12 of the cover part 6. Accordingly, the size of this deformation is depending on the overall size of said front side of the cover part 6. This bulging of the front side 12 of the cover part 6 is at least in part compensated for by forming the retainment projections 26 along a convex curve, so that the noses 28 of the upwardly extending retainment projections 26 closest to the end sides of the bottom part 4 are placed closest to the front side 24 of the bottom part 4. The relative offset D of the noses 26 may be between 0.3 mm and 2 mm, preferably between 0.3 mm and 1 mm. Investigations performed by the applicant have shown that good results may be achieved within these ranges, by for example using an offset D of 0.5 mm. It is a great advantage that these offsets can be performed by incorporating only minor changes in the already existing form tools used for other egg packages.

In a further embodiment, the co-operating apertures 30 in the front surface 12 of the cover part 6 are offset upwardly and/or downwardly relative to each other when the egg package 2 is formed. Hereby is achieved a more reliable locking function of the egg package 2. The relative offset of the co-operating apertures 30 in the front surface 12 of the cover part 6 may be between 0.3 mm and 2 mm, preferably between 0.5 mm and 1.3 mm, for example 1 mm.

Figure 9:
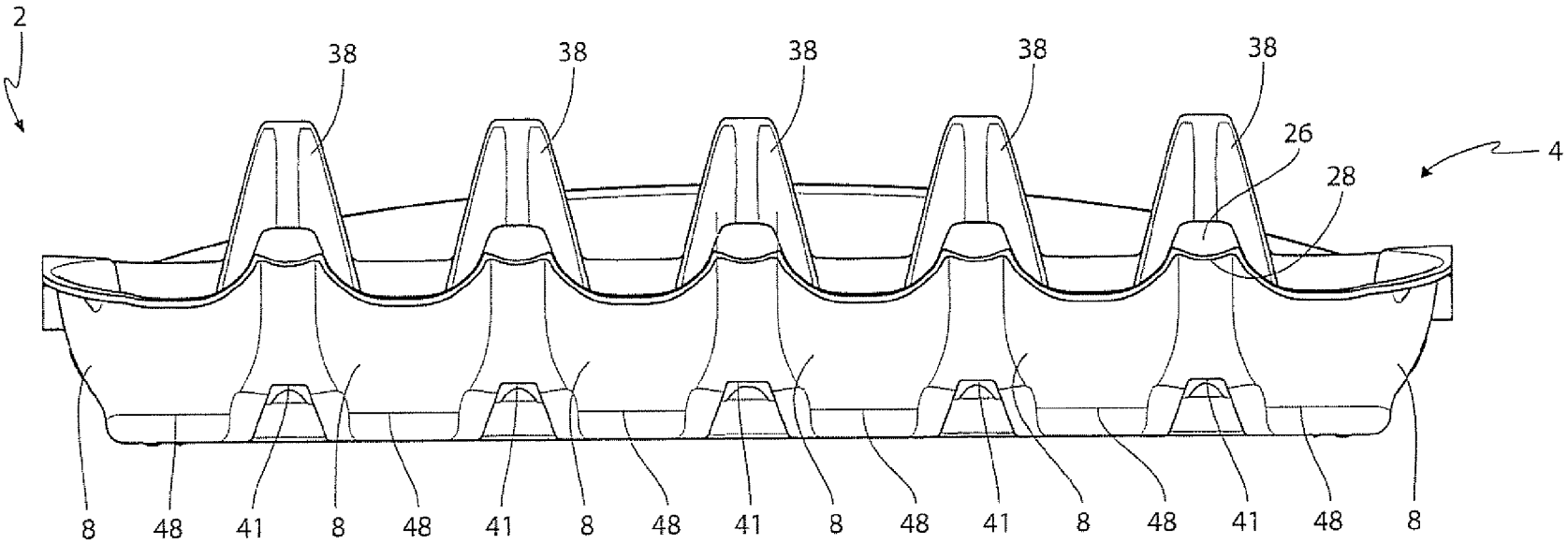
FIG. 9 shows an embodiment of an egg package according to the invention in an open position seen from the front side.

FIG. 9 shows the same egg package 2 as illustrated in FIG. 8, also in the open position, and seen from the front side. In this view the raised pillow posts 41 are illustrated. The height of these pillow posts 41 is at least 7 mm as measured from the bottom 48 of the neighboring egg receiving compartments 8.

LIST OF REFERENCE NUMBERS

In the following is given a list of reference numbers used in the detailed description of the invention.

2 egg package,
4 bottom part,
6 cover part,
8 egg receiving compartments,
top surface of the cover part,
12 front surface of the cover part,
14 back surface of the cover part,
16 hinge,
18 substantially planar rim part,
20 partially ovoid portions,
22 back side of bottom part,
24 front side of bottom part,
26 upwardly extending retainment projection,
28 outwardly and downwardly extending nose,
30 apertures in the front surface of the cover part,
32 concave middle section,
38 upwardly extending projections of the cover part,
39, 41, 43 pillow posts,
40 upwardly and inwardly extending retainment tongue in the cover part,
42 label,
44 interface between the cover part and the bottom part,
46 lower edge of the front surface of the cover part,
47 embossment, and
48 bottom of an egg receiving compartment.

The invention claimed is:

1. A method of manufacturing an egg package by suction moulding of a fibrous material, the package comprising:

a bottom part comprising a plurality of egg receiving compartments having non-planar side surfaces so as to match at least partially the outer contours of an egg, the plurality of egg receiving compartments being formed in at least two parallel rows, a cover part comprising a top surface, a front surface, a back surface, and two end surfaces, the cover part being permanently connected to the bottom part by a hinge between the back surface of the cover part and the bottom part so as to allow the cover part to move between an open position and a closed position, the bottom part comprising a back side, a front side, two end sides, and an upwardly extending retainment projection extending from the front side of the bottom part, the upwardly extending retainment projection having a downwardly and outwardly extending nose for locking engagement with the bottom of a cooperating aperture in the front surface of the cover part, the nose not extending beyond the front surface of the cover part when the cover part is in its closed position, the method comprising the steps of:

placing said retainment projection and cooperating aperture relative to each other during moulding of the egg package in a moulding form, such that the front of the cover part is located inwardly from the retainment projection such that when removed from the moulding form, the retainment projection and the cooperating aperture are spaced apart with an offset from each other such that they cannot be lockingly engaged, removing the egg package from the moulding form, and drying said egg package in an oven such that the front of the cover part deforms by moving outwards toward the front of the bottom part to a position at which, upon closing of the cover part onto the bottom part, the aperture and retainment projection are positioned to lockingly engage each other.

2. The method according to claim 1, further comprising the step of attaching a label to the top surface and front surface of the cover part with an adhesive.

3. The method according to claim 1, further comprising the step of forming a pillow post between each two neighboring egg receiving compartments, wherein at least one pillow post, which is formed between the egg receiving compartments adjacent to the front side of the bottom part, is higher than 7 mm as measured from the bottom of the neighboring egg receiving compartments.

4. The method according to claim 3, wherein the at least one pillow post, which is formed between the egg receiving compartments adjacent to the front side of the bottom part, has a height between 7 mm and 20 mm, as measured from the bottom of the neighboring egg receiving compartments.

5. The method according to claim 1, wherein said egg package comprises at least eight egg receiving compartments formed in two parallel rows, and at least three upwardly extending retainment projections, and wherein the moulding step includes forming a plurality of retainment projections along an outwardly convex curve, so that the noses of the upwardly extending retainment projections closest to the end sides of the bottom part are placed closest to the front side of the bottom part.

6. The method according to claim 5, wherein the relative offset of adjacent noses is between 0.3 mm and 2 mm.

7. The method according to claim 5, wherein the cooperating apertures in the front surface of the cover part are offset upwardly and/or downwardly relative to each other when the egg package is formed.

8. The method according to claim 7, wherein said relative offset of the cooperating apertures in the front surface of the cover part is between 0.3 mm and 2 mm.

9. The method according to claim 1, further comprising the step of forming a tongue in the cover part extending upwardly and inwardly from the lower edge of the lower edge of the aperture being substantially flush with the front surface of the cover part, and said tongue being configured for cooperating with the outwardly and downwardly extending nose.

10. The method according to claim 1, further comprising the step of forming a downwardly curved lower edge in the front surface of the cover part, which during use will extend in a direction beneath an interface between the cover part and bottom part, thereby extending the area of the front surface and facilitating opening of the egg package.

11. The method according to claim 1, wherein the bottom of the cooperating aperture is formed with an inwardly projecting tongue.

12. A method of manufacturing an egg package by suction moulding a fibrous material, wherein the package comprises:

a bottom part with a plurality of egg receiving compartments arranged in one or more rows, the bottom part having a back and a front, and a cover part having a back which is connected to the back of the bottom part and a front which overlaps the front of the bottom part, wherein the bottom part includes at its front upwardly extending retainment projections and the front of the cover part has apertures which align with the retainment projections to hold the package closed, the method including the steps of:

initially moulding the package in a moulding form with the retainment projections being arranged along an outwardly convex curve, and with the apertures of the cover part arranged along a row, wherein the apertures and their corresponding retainment projections are spaced apart from each other with an offset such that the retainment projections are not positioned to lockingly engage their respective apertures, and drying the egg package such that the row of apertures moves outwardly toward the convex curve of the retainment projections, such that the retainment projections and the apertures are then positioned to lockingly engage each other during closing of the egg package.

13. The method of claim 12, wherein in the egg package after drying, the retainment projections are arranged along said convex curve to include a central retainment projection and one or more retainment projections on each side of the central retainment projection, wherein the one or more retainment projection on each side of the central retainment projection is offset back from its retainment projection closest to the central retainment projection by 0.3 mm to 2 mm.

14. The method according to claim 13, wherein the offset is 0.3 mm to 1 mm.

15. The method according to claim 13, including cooperating apertures in the front surface of the cover part which are offset upwardly and/or downwardly relative to each other when the egg package is formed.

16. The method according to claim 15, wherein the relative offset in the front surface of the cover part is between 0.3 mm and 2 mm.

17. The method according to claim 15, wherein said relative offset of the cooperating apertures in the front surface of the cover part is between 0.5 mm and 1.3 mm.

18. A method of handling an egg package during closing thereof to provide a reliable locking of a cover part of the egg package to a bottom part of the egg package, comprising:

forming in the front of the cover part an aperture with a bottom formed with an inwardly and upwardly extending tongue, forming on the front of the bottom part an upwardly extending retainment projection having a forward end with a nose which extends downwardly, which nose does not extend forward of the front of the cover part when it is located in the aperture, and closing the egg package by bringing the front of the cover part down onto the front of the bottom part as the tongue flexes outwardly as it rides over the retainment projection, and then returns to its original position when it passes below the retainment projection, such that the retainment projection is locked in its aperture by being restrained against upward movement of the tongue and hence of the cover.

19. The method according to claim 18, wherein the cover part comprises a plurality of said apertures and the bottom part comprises a plurality of corresponding retainment projections, and wherein the step of closing the egg package includes simultaneously causing all of the retainment projection tongues to be locked in their respective corresponding apertures.

20. The method according to claim 19, wherein the plurality of retainment projections are arranged along an outwardly convex curve and the plurality of apertures are also arranged along an outwardly convex curve.

* * * * *